US007384109B2

(12) United States Patent
Huang et al.

(10) Patent No.: US 7,384,109 B2
(45) Date of Patent: Jun. 10, 2008

(54) METHOD AND APPARATUS OF FLEXIBLY CONTROLLING PRINT THROUGHPUT AND QUALITY

(75) Inventors: Yu-Chu Huang, Taipei (TW); Yi-Che Chen, Baoshan Township, Hsinchu County (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 303 days.

(21) Appl. No.: 11/148,605

(22) Filed: Jun. 8, 2005

(65) Prior Publication Data

US 2006/0209105 A1 Sep. 21, 2006

(30) Foreign Application Priority Data

Mar. 17, 2005 (TW) ..... 94108143 A

(51) Int. Cl.
*B41J 29/38* (2006.01)

(52) U.S. Cl. ..... 347/5; 347/9; 347/12

(58) Field of Classification Search ..... 347/5, 347/9, 12–13, 40–41
See application file for complete search history.

(56) References Cited

U.S. PATENT DOCUMENTS

| | | | | |
|---|---|---|---|---|
| 4,963,882 | A | 10/1990 | Hickman | 347/41 |
| 5,469,198 | A | 11/1995 | Kadonaga | 347/41 |
| 5,502,792 | A | 3/1996 | Chen et al. | 358/1.8 |
| 5,604,519 | A | 2/1997 | Keefe et al. | 347/13 |
| 6,315,388 | B1 | 11/2001 | Goh | 347/40 |

*Primary Examiner*—Lam S Nguyen
(74) *Attorney, Agent, or Firm*—J.C. Patents

(57) ABSTRACT

A method and an apparatus of flexibly controlling printing speed and quality are disclosed. The method controls the inkjet printhead module under the draft print mode. According to the moving distance of the inkjet printhead module, the apparatus generates the address sequence reset signal. According to the address sequence reset signal, the apparatus outputs a plurality of address signals to the printhead. When the address sequence reset signal is enabled, the apparatus re-outputs the address signal to the printhead and transmits the primitive data to the printhead according to the sequence of the address signals.

12 Claims, 6 Drawing Sheets

METHOD AND APPARATUS OF FLEXIBLY CONTROLLING PRINT THROUGHPUT AND QUALITY

CROSS-REFERENCE TO RELATED APPLICATION

This application claims the priority benefit of Taiwan application serial no. 94108143, filed on Mar. 17, 2005. All disclosure of the Taiwan application is incorporated herein by reference.

BACKGROUND OF THE INVENTION

1. Field of the Invention

The present invention relates to a method and an apparatus of driving an inkjet printer, and more particularly, to a method and an apparatus of flexibly controlling print quality and throughput of an inkjet printer.

2. Description of the Related Art

A thermal bubble inkjet printer is one of the most popular printer types for the time being. The method of controlling inkjet printhead has been disclosed by U.S. Pat. No. 5,604,519, owned by Hewlett-Packard Company, titled "Inkjet Printhead Architecture for High Frequency Operation". FIG. 1 is a drawing showing an internal circuit of a prior art nozzle at an inkjet printhead of an inkjet printer. The nozzle of the inkjet printhead in FIG. 1 comprises a heater resistor, an address signal line 102 and a primitive signal line 104, wherein the address signal line 102 and the primitive signal line 104 are used to drive the nozzle. The heater resistor is connected to high voltage only when both the address signal line 102 and the primitive signal line 104 are driven, which in turn, generates heat to boil the ink. While the heater resistor 100 is heated to vaporize and eject the ink stored in the ink chamber of the nozzle, simultaneously driving the address signal 102 and the primitive signal line 104 is required. On the nozzle surface of the inkjet printhead, nozzles are divided into several nozzle primitive areas. A group of neighboring nozzles constitute a nozzle primitive. Each nozzle of the nozzle primitive has its own address. According to the selected address signal line 102 and the nozzle primitive signal line 104, the selected nozzle is driven for inkjet. In every nozzle primitive, only one nozzle is driven. It means that each address signal line 102 is independently and sequentially driven until all of the address signal lines 102 are driven. All of the nozzle positions of the inkjet printhead are scanned once. The primitive data then are transmitted to the nozzle primitive signal lines 104 so that the selected nozzle correctly ink jets. FIG. 2 is a drawing showing a relationship between address signals and nozzle primitive signals. When an address signal line is driven, the corresponding primitive data are transmitted to the nozzle primitive signal line. FIG. 3 is a drawing showing a driving of an inkjet printhead with seven address signal lines A1-A7. Referring to FIG. 3, all of the address signal lines are driven sequentially. The description above is the operation of the basic driving for the thermal bubble inkjet printhead.

During an inkjet print swath, a print controller controls the above operation during the period between each column. The horizontal resolution of columns depends on the desired horizontal print resolution (pixel resolution, for example, 600 dpi). In other words, the print controller drives each address signal line, loads the primitive data to the corresponding nozzle primitive signal line, and drives the nozzle to jet ink dots through a pen driver. Determining whether the printhead reaches the pixel column is fed back from an encoder strip sensor of a carriage when the printhead passes through the print swath. The feedback is the encoded signal Enc of the pixel area in FIG. 3. There are seven address signals A1-A7, which are to be sequentially driven between two pixels. The waveform width of the nozzle primitive signal in the address signal waveform must be so large that a desired energy is provided to the nozzle heat resistor to form and jet the optimized droplet shape and size. Accordingly, the address signal waveform width corresponding to the design of the printhead is almost a constant. This constant but might be different for different print heads, for example, it needs from 2 us to 4 us to drive HP heads of different generations. When the print resolution is increased, or the moving speed of the inkjet printhead is accelerated, the time for the inkjet printhead to pass through two pixels is reduced. The time is also limited by performing the sequence of the address signals so as restrain the print throughput.

For a general inkjet printing, print quality and print throughput affect each other. For a printing with micro ink droplets, such as smaller than 5 pico liter, to diversify the color level changes, a multi-pass print method is required. According to multiple layers of ink jetting colors of the multi-pass print method, the desired print quality of pictures can be obtained. This method, however, reduces the print throughput. Regarding the multi-pass printing, references can be obtained from U.S. Pat. No. 4,963,882 and U.S. Pat. No. 5,469,198, owned by Hewlett-Packard Company.

Among the variety of print modes, the requirement for the print throughput of the draft print mode is very high. Once the draft print mode is selected, the user expects seeing the result of the print object in a very short period of time. Similarly, the expectation of the print quality of the object is relatively reduced. According to the U.S. patent applications, it is found that the worldwide leading printer companies have committed to enhancing and improving the print throughput of the draft print mode.

FIG. 4A is a drawing showing a print encoded signal Enc and an address signal waveform according to a prior art draft mode. During the printing swath, if the moving speed of the inkjet printhead is increased, the frequency of the encoded feedback signal of the pixel position will also be increased. It means that the time between two neighboring encoded signals is reduced. As described above, to maintain the optimized ink droplet shape and size, the waveform width of the address signal and the inkjet primitive signal should be maintained at a constant. Referring to FIG. 4A, the time 40 at driving the signal A7 has passed the encoded signal feedback period that causes the encoded feedback signal 41 of the pixel being omitted. The print controller does not access and print the data stored in the encoded feedback signal of the omitted ones until the next encoded signal comes. Accordingly, the print horizontal resolution becomes half of what it should be. This data print error results in the horizontal extension of the print output image. For example, the print throughput under the draft print mode is restrained. The restrained moving speed of the inkjet printhead causes the print output image in error. A value over the restrained speed would cause the error printout. Of course, the distorted output image is unacceptable by users.

In order to solve the issue mentioned above, U.S. Pat. No. 6,315,388, owned by Hewlett-Packer Company, titled "Draft Printing" discloses a solution method. According to this method, half of the address signals are omitted in each pixel column. Referring to FIG. 4B, only the address signals A1, A3, A5 and A7 are used in the first pixel column, and the address signals A2, A4, A6 and A8 are used in the next pixel column. Accordingly, the print throughput of the inkjet printhead is doubled and the purpose of enhancing the print throughput is achieved. Under this patent, the the half of nozzles would be disabled (since their address signals are ignored). For one hundred percent coverage data, the ink dots must be exactly reduced by half. The enhanced print throughput is fixed. A user can not select a balance between the print quality and print throughput. Additionally, the moving speed of the inkjet head is still limited by the sequence of the halved address signals.

SUMMARY OF THE INVENTION

Accordingly, the present invention is directed to an apparatus of flexibly controlling printing quality and throughput. The apparatus is adapted to control an inkjet printer module of an inkjet printer. In the draft print mode, the print output will not be distorted even without using a sophisticated algorithm.

The present invention is also directed to a method of flexibly controlling print quality and throughput. The method is adapted to control an inkjet printer module of an inkjet printer. In the draft print mode, the print output result is of accurate form even without using a sophisticated algorithm.

The present invention provides an apparatus of flexibly controlling print throughput and quality. The apparatus comprises an inkjet firing signal generator, an address sequencer and a primitive data finder. The inkjet generator is coupled to the inkjet printer module. The inkjet firing signal generator receives a carriage encoder pulse signal. According to a predetermined moving distance of the printhead module, an address sequence reset signal is generated. The address sequencer, according to the address sequence signal, outputs a plurality of address signals to the inkjet printer module. When the address sequence reset signal is enabled, the address signals are re-outputted. The primitive data finder, according to a sequence of the address signals, outputs the primitive data to the inkjet printer module.

Accordingly, the address sequencer randomly determines the sequence of the address signals which are outputted, or presets a reference table to determine the sequence of the signals which are outputted.

According to a preferred embodiment of the present invention, the apparatus of flexibly controlling print throughput and quality further comprises a pixel data memory to store and provide the primitive data.

According to a preferred embodiment of the present invention, the apparatus of flexibly controlling print throughput and quality further comprises a control module to control a print throughput of the inkjet printer module according to a user's command.

According to a preferred embodiment of the present invention, the apparatus of flexibly controlling print throughput and quality further comprises a user interface to receive a user's command outputted from the user interface to control a print throughput of the inkjet printer module.

Accordingly, the user interface can be a printer driving program of a computer terminal or a panel operation input of a printer.

The present invention provides a method of flexibly controlling print quality and throughput. The method is adapted to control an inkjet printer module of an inkjet printer. According to the method, an address sequence reset signal is generated according to a moving distance of the inkjet printhead module. A plurality of address signals is outputted to the inkjet printer module according to the address sequence reset signal. When the address sequence reset signal is enabled, the address signals are re-outputted. The primitive data are outputted to the inkjet printer module according to a sequence of the address signals.

Accordingly, when the address sequence reset signal is enabled, the sequence of the address signals which are outputted is randomly determined to re-output the address signals.

Accordingly, when the address sequence rest signal is enabled, the address signals are re-outputted according to the preset output sequence of the address signals.

According to a preferred embodiment of the present invention, the method of flexibly controlling print throughput and quality further comprises using a user interface to adjust a print throughput by setting a moving speed of the inkjet printhead.

According to the present invention, a plurality of address signals is outputted to the inkjet printer module based on the address sequence reset signal. When the address sequence reset signal is enabled, the address signals are re-outputted. Therefore, in the draft print mode, the print output distortion will not occur even without using a sophisticated algorithm.

The above and other features of the present invention will be better understood from the following detailed description of the preferred embodiments of the invention that is provided in communication with the accompanying drawings.

DESCRIPTION OF SOME EMBODIMENTS

Figure 1:
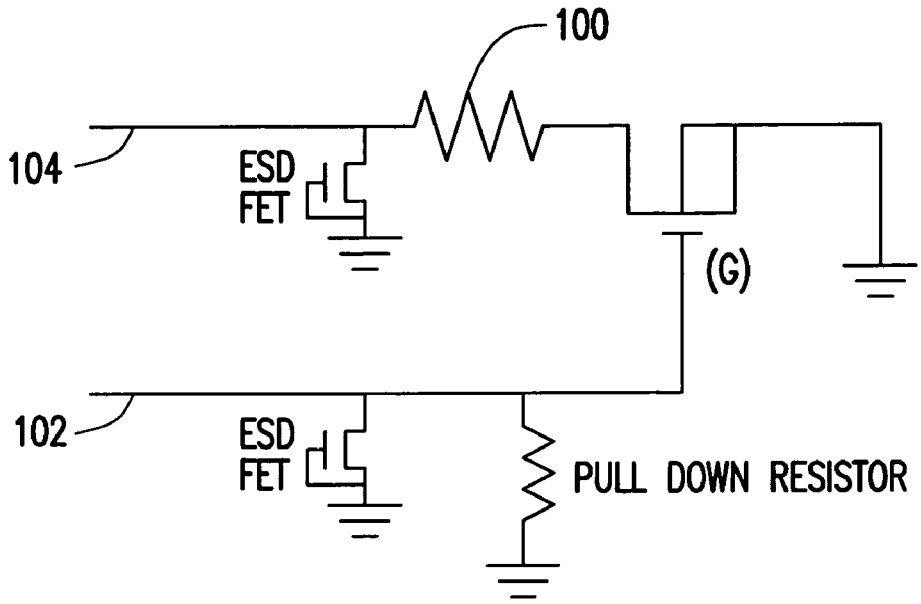
FIG. 1 (PRIOR ART)
FIG. 1 is a drawing showing an internal circuit of a prior art nozzle at an inkjet printhead thermal ink jet print head of an inkjet printer.
Figure 2:
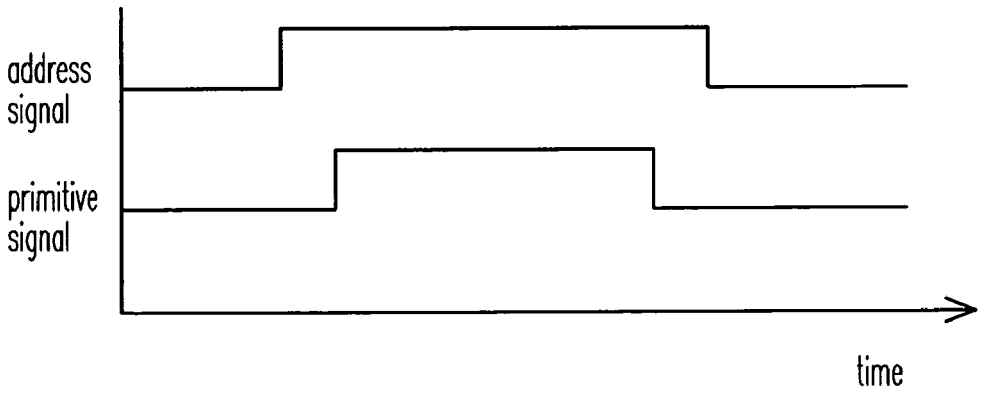
FIG. 2 (PRIOR ART)
FIG. 2 is a drawing showing a waveform relationship between address signals and nozzle primitive signals of the prior art.
Figure 3:
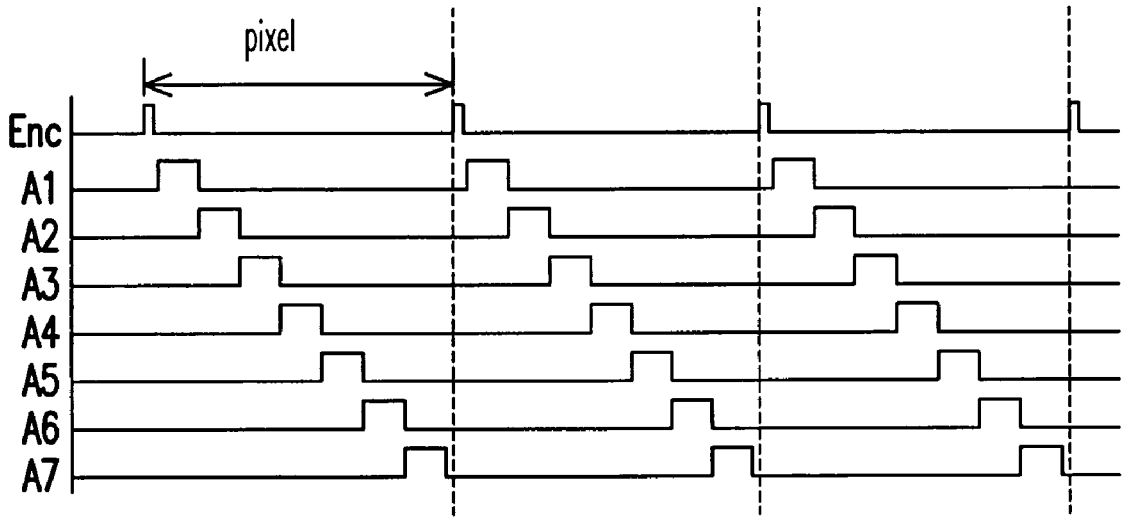
FIG. 3 (PRIOR ART)
FIG. 3 is a drawing showing a waveform relationship between an encoded signal Enc and an address signal waveform of a prior art pixel area.
Figure 4A:
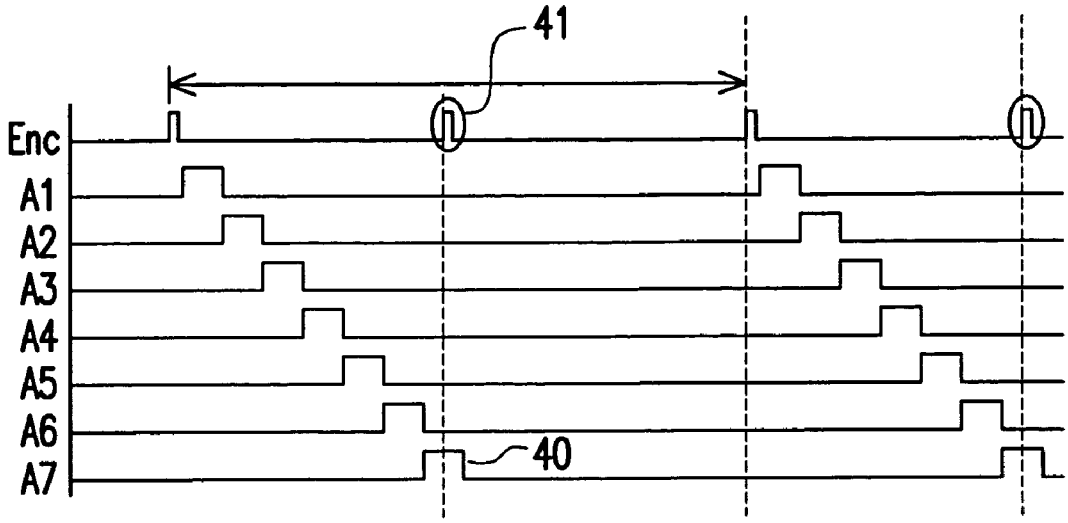
FIG. 4A (PRIOR ART)
FIG. 4A is a drawing showing a print encoded signal Enc and an address signal waveform according to a prior art draft print mode.
Figure 4B:
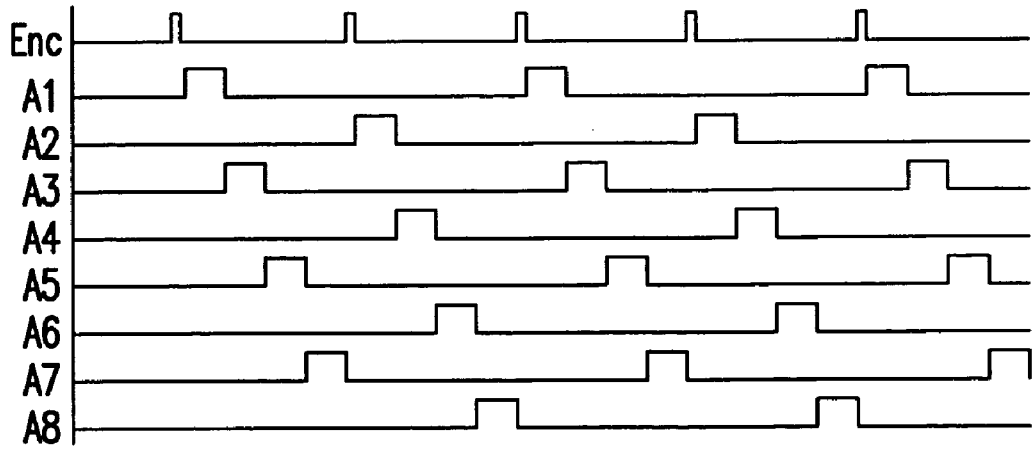
FIG. 4B (PRIOR ART)
FIG. 4B is a drawing showing a waveform of a print address signal according to the U.S. Pat. No. 6,315,388, owned by Hewlett-Packer Company, titled "Draft Printing".
Figure 5:
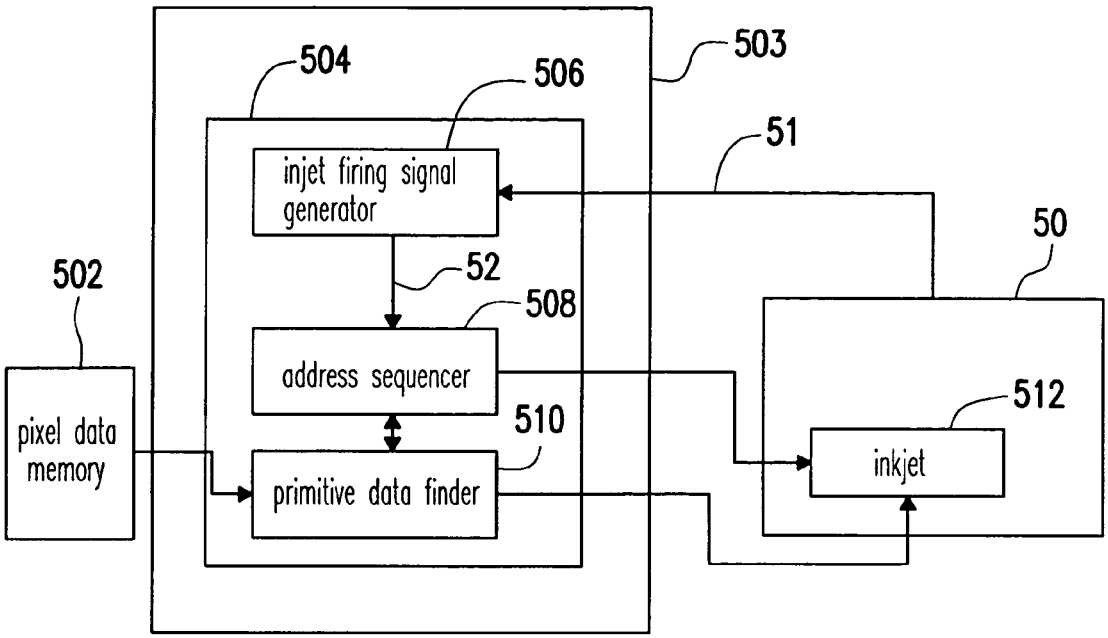
FIG. 5 is a schematic drawing showing an apparatus of flexibly controlling print quality and throughput according to a preferred embodiment of the present invention.

FIG. 5 is a schematic drawing showing an apparatus of flexibly controlling print quality and throughput according to a preferred embodiment of the present invention. Referring to FIG. 5, the apparatus comprises the inkjet printer module 50, the pixel data memory 502 and the inkjet print controller 503. The inkjet print controller 503 comprises an apparatus 504 of flexibly controlling print quality and throughput. Wherein, the apparatus 504 of flexibly controlling print quality and throughput comprises the inkjet firing signal generator 506, the address sequencer 508 and the primitive data finder 510. The inkjet printer module 50 comprises the inkjet printhead module 512. The pixel data memory 502 is coupled to the primitive data finder 510. The input terminal of the inkjet firing signal generator 506 is coupled to the inkjet printer module 50 and its output terminal is coupled to the address sequencer 508. The input terminal of the address sequencer 508 is coupled to the inkjet firing signal generator 506, the primitive data finder 510 and the inkjet printhead module 512 of the inkjet printer module 50. The primitive data finder 510 is coupled to the address sequencer 508, the pixel data memory 502 and the inkjet printhead module 512 of the inkjet printer module 50.

The inkjet firing signal generator 506 receives the carriage encoder pulse signal 51 to generate an address sequence reset signal 52. The carriage encoder pulse signal 51 is generated according to a moving distance of the inkjet printhead module 512 of the inkjet printer module 50. The address sequencer 508 receives the address sequence reset signal 52 and outputs a plurality of address signals to the inkjet printer module 50. When the address sequence reset signal is enabled, the address signals are re-outputted. The primitive data finder 510 outputs the primitive data to the inkjet printhead module 512 of the inkjet printer module 50 according to the output sequence of the address signals.

Figure 6:
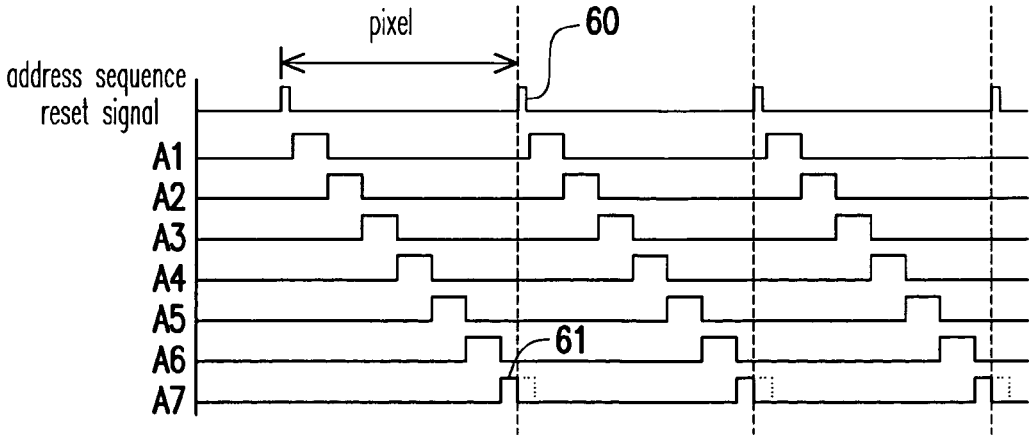
FIG. 6 is a drawing showing a relationship between an address sequence reset signal and an address signal waveform of an apparatus of flexibly controlling print quality and throughput according to a preferred embodiment of the present invention.

FIG. 6 is a drawing showing a relationship between an address sequence reset signal and an address signal waveform of an apparatus of flexibly controlling print quality and throughput according to a preferred embodiment of the present invention. Referring to FIGS. 5 and 6, during fast printing the inkjet printhead module 512 of the inkjet printer module 50 moves so fast that the time for each pixel time period for each pixel column is reduced. Accordingly, the feedback frequency of the carriage encoder pulse signal 51 outputted from the inkjet printer module is also increased. The cycle period of the address sequence reset signal 52 becomes shorter. Since the feedback frequency of the carriage encoder pulse signal 51 is increased, the frequency of the address sequence reset signal 52 generated from the inkjet firing signal generator 506 is increased as well. In order to perform fast printing and avoid the print output error that distort images, when the address sequence reset signal 60 is enabled, the address signal 61 is ignored. The address sequencer 508 then re-outputs the address signals and transmits the output sequence to the primitive data finder 510. According to the output sequence of the address signals, the primitive data are outputted to the inkjet printhead module 512 of the inkjet printer module 50 to prevent the image print distortion.

Figure 7:
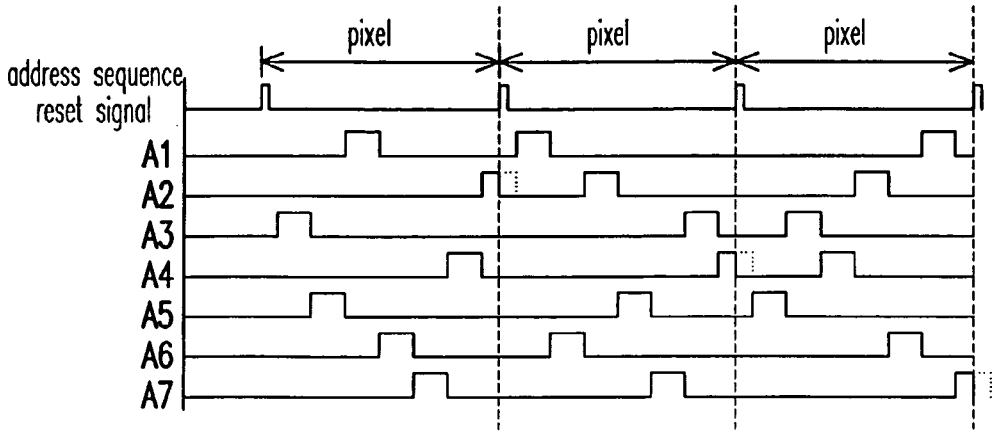
FIG. 7 is a drawing showing a relationship between an address sequence reset signal waveform and an address signal sequence randomly outputted by an address sequencer of an apparatus of flexibly controlling print quality and throughput according to a preferred embodiment of the present invention.

In FIG. 6, the address sequencer 508 follows the sequence and outputs the address signals. If the same address signal is omitted every time, though the image print distortion is avoided, the part omitted from the whole image will be from the same address signal. As a result, several thin open (or white) lines on every swath will appear on the whole image. (For example, if A7 is always omitted, the nozzles (must not be a single one) driven by A7 with all PS signals would be failed to jet inks. Since these nozzles are ignored within a whole swath, several open lines regarding these nozzles would be observed from printouts.) The drawback of the printing is called Banding phenomenon. The present invention also provides a method to eliminate the phenomenon. FIG. 7 is a drawing showing a relationship between an address sequence reset signal waveform and an address signal sequence randomly outputted by an address sequencer of an apparatus of flexibly controlling print quality and throughput according to a preferred embodiment of the present invention. Referring to FIGS. 5 and 7, the address sequencer 508 may randomly output the address signals so that the chance each address signal being omitted is equal. Accordingly, the print quality under the fast (draft) print mode is within an acceptable range. In some embodiments, the sequence to output the address signals by the address sequencer 508 can be preset. When the fast printing is triggered, each omitted address is preset. Accordingly, the print quality under the fast (draft) print mode is also within an acceptable range.

Figure 8:
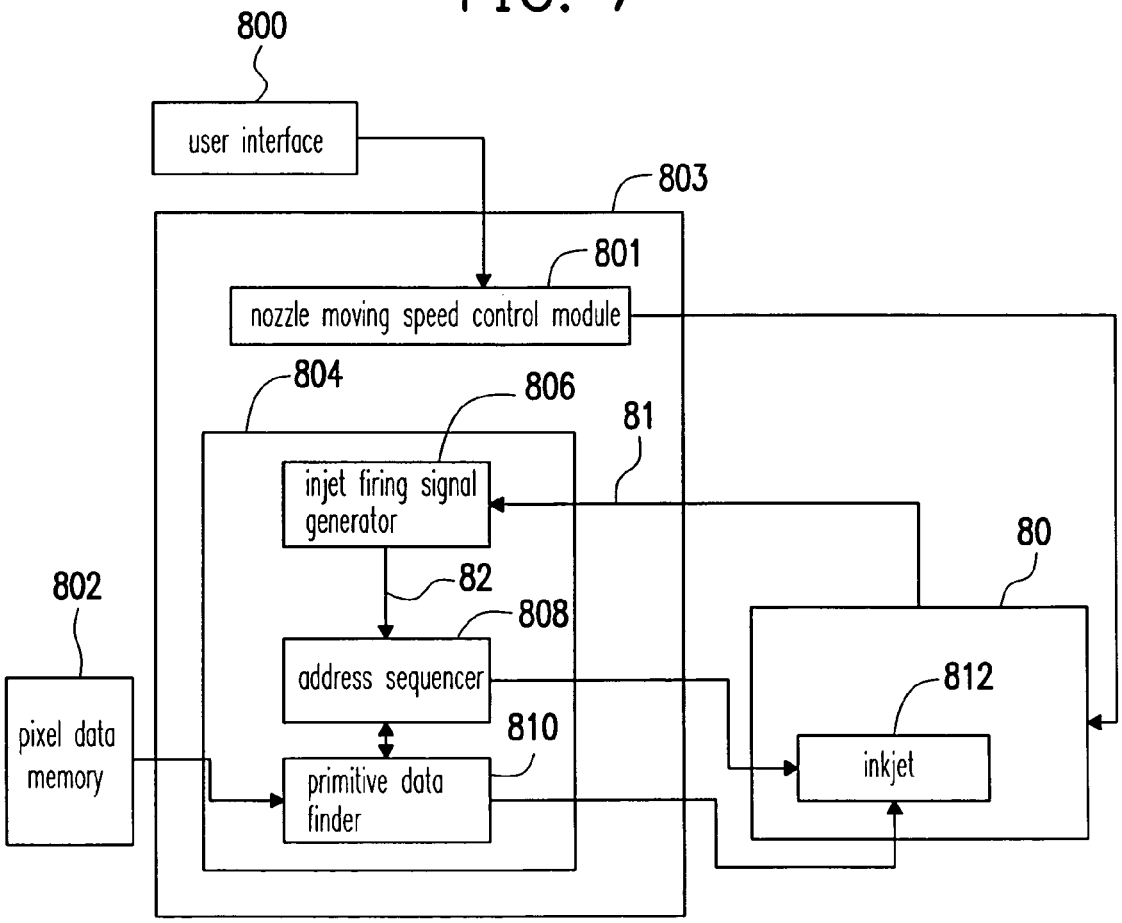
FIG. 8 is a block diagram showing an apparatus of flexibly controlling print quality and throughput according to another embodiment of the present invention.

The apparatus of flexibly controlling print quality and throughput may further comprise a user interface 800; and a control module 801 is added in the printer controller 803. Referring to FIG. 8, the user interface 800 can be, for example, a computer driver program or an operation input of a printer panel. A user may determine the print quality and throughput by operating the panel or the computer. The user's command is transmitted to the control module 801. According to the user's command, the control module 801 controls the print throughput of the inkjet printer module 80 to determine the moving speed of the inkjet printhead module 812. It also means that by controlling the moving speed the next step is to control the address signals which are omitted. (The controlling procedure is the same as described above.) The advantage of this apparatus is that the print quality and throughput can be divided into several levels. If the user wants a high print quality, he/she can decide that no address signals are to be omitted. When a fast printing is desired, one, two or more address signals can be omitted.

Figure 9:
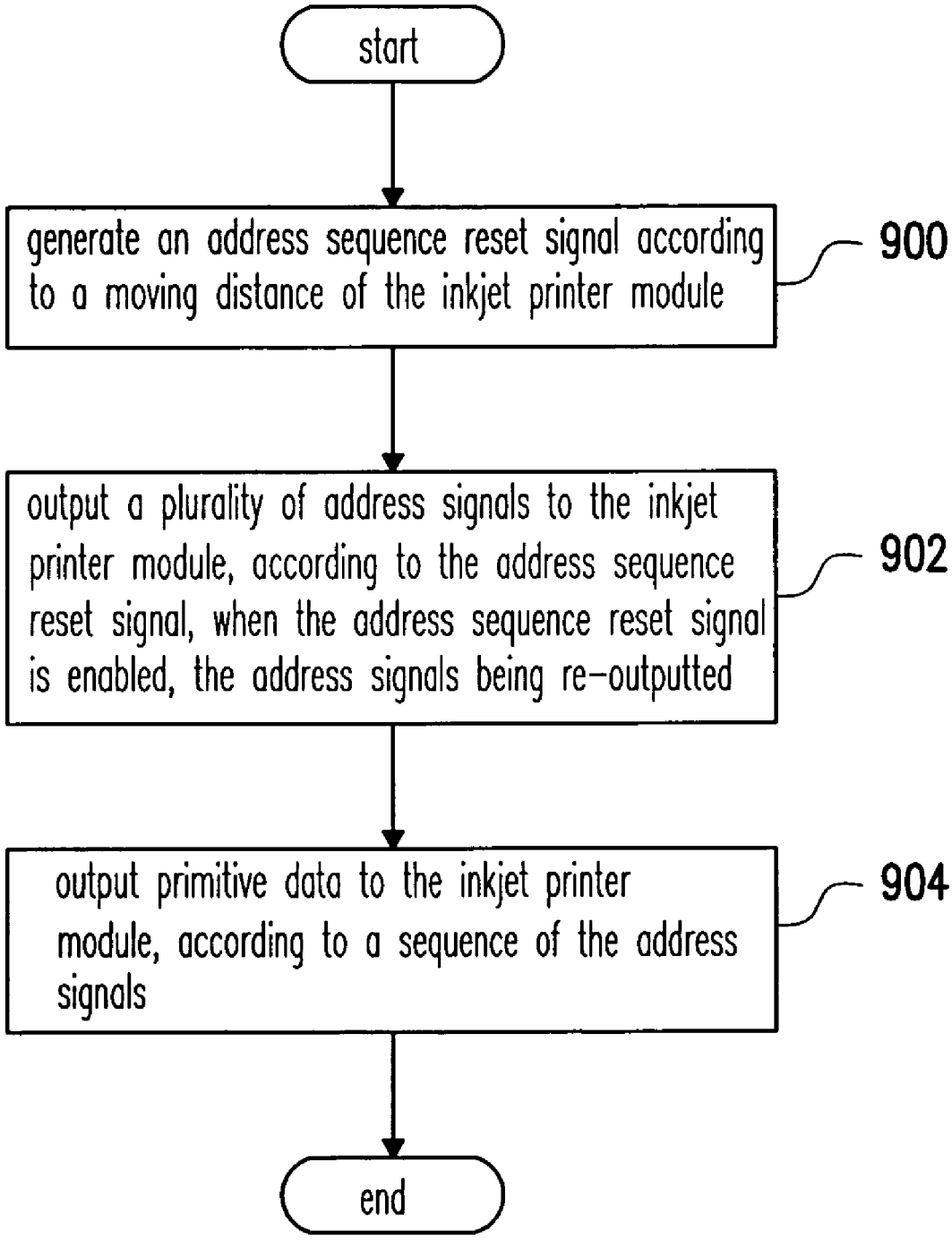
FIG. 9 is a drawing showing a flowchart of a method of flexibly controlling print quality and throughput according to a preferred embodiment of the present invention.

FIG. 9 is a drawing showing a flowchart of a method of flexibly controlling print quality and throughput according to a preferred embodiment of the present invention. Referring to FIGS. 5-7, according to the moving pixel distance of the inkjet printhead module 512 of the inkjet printer module 50, the carriage-position coded signal 51 is generated. The inkjet firing signal generator 506 receives the carriage-position coded signal 51 and generates the address sequence reset signal 52 according to the carriage-position coded signal 51 (step 900). According to the address sequence reset signal 52, the address sequencer 508 outputs the address signals to the inkjet printer module. When the address sequence reset signal is enabled, the address signals are re-outputted (step 902). According to the output sequence of the address signals, the primitive data finder 510 outputs the primitive data to the inkjet printer module (step 904).

According to the method of flexibly controlling print quality and throughput described above, when the address sequence reset signal is enabled, the output sequence of the address signals can be randomly determined or determined by a preset sequence of the address signals. Then, the address signals are re-outputted.

The method of flexibly controlling print quality and throughput described above may further comprise using the user interface to adjust the print throughput by setting the print throughput of the inkjet printer module 80 as shown in FIG. 8.

Accordingly, the present invention adopts the encoder feedback signal indicating pixel columns of the prior art technology to be served as the address sequence reset signal. During the fast printing, the address signals which are unable to be printed in time will be omitted so that the distance between pixel dot columns could be correctly maintained. Thus, the fast (draft) printing will not result in print extension in the horizontal direction. In order to maintain the draft print quality, the sequence of the address signals is randomly determined or determined by the preset output sequence of the address signals. Accordingly, the draft print quality is maintained.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. An apparatus of flexibly controlling print throughput and quality, the apparatus being adapted to control an inkjet printer module of an inkjet printer, the inkjet printer module comprising an inkjet printhead module, the apparatus comprising:

an inkjet firing signal generator, coupled to the inkjet printer module, the inkjet firing signal generator receiving a carriage encoder pulse signal, and according to a predetermined moving distance of the printhead module, generating an address sequence reset signal;

an address sequencer, coupled to the inkjet firing signal generator and the inkjet printer module, the address sequencer receiving the address sequence reset signal and outputting a plurality of address signals to the inkjet printer module; wherein when the address sequence reset signal is enabled and the inkjet printer is in a draft print mode, all of the address signals are disabled whether the address signals have all been outputted or not, and then the address signals are re-outputted; and a primitive data finder, coupled to the address sequencer and the inkjet printer module, according to an output sequence of the address signals, the primitive data finder outputting primitive data to the inkjet printer module.

2. The apparatus of flexibly controlling print throughput and quality of claim 1, wherein the address sequencer randomly determines the output sequence of the address signals.

3. The apparatus of flexibly controlling print throughput and quality of claim 1, wherein the address sequencer presets a reference table to determine the output sequence of the signals.

4. The apparatus of flexibly controlling print throughput and quality of claim 1, wherein the apparatus is coupled to a pixel data memory to store and provide the primitive data.

5. The apparatus of flexibly controlling print throughput and quality of claim 1, wherein the apparatus is coupled to a user interface and receives a user's command outputted from the user interface to control a print throughput of the inkjet printer module.

6. The apparatus of flexibly controlling print throughput and quality of claim 5, wherein the user interface is a printer driver program of a computer terminal.

7. The apparatus of flexibly controlling print throughput and quality of claim 5, wherein the user interface is a panel operation input of a printer.

8. The apparatus of flexibly controlling print throughput and quality of claim 5, further comprising a control module controlling the print throughput of the inkjet printer module according to the user's command.

9. A method of flexibly controlling print quality and throughput, adapted to control an inkjet printer module of an inkjet printer, the inkjet printer module comprising an inkjet printhead module, the method for controlling print quality and throughput comprising:

generating an address sequence reset signal according to a predetermined moving distance of the inkjet printhead module;

outputting a plurality of address signals to the inkjet printer module according to the address sequence reset signal, wherein when the address sequence reset signal is enabled and the inkjet printer is in a draft print mode, all of the address signals being disabled whether the address signals have all been outputted or not, and then the address signals are re-outputted; and outputting primitive data to the inkjet printer module according to an sequence of the address signals.

10. The method of flexibly controlling print quality and throughput of claim 9, wherein when the address sequence reset signal is enabled, the output sequence of the address signals is randomly determined to re-output the address signals.

11. The method of flexibly controlling print quality and throughput of claim 9, wherein when the address sequence rest signal is enabled, the address signals are re-outputted according to the preset output sequence of the address signals.

12. The method of flexibly controlling print quality and throughput of claim 9, further comprising using a user interface to adjust a print throughput by setting a speed of the inkjet printhead.

* * * * *